US008604370B2

(12) United States Patent
Chao

(10) Patent No.: US 8,604,370 B2
(45) Date of Patent: Dec. 10, 2013

(54) LUMINOUS KEYBOARD

(75) Inventor: Ling-Hsi Chao, Taoyuan (TW)

(73) Assignee: Darfon Electronics Corp., Gueishan, Taoyuan (TW)

( * ) Notice: Subject to any disclaimer, the term of this patent is extended or adjusted under 35 U.S.C. 154(b) by 145 days.

(21) Appl. No.: 13/337,298

(22) Filed: Dec. 27, 2011

(65) Prior Publication Data

US 2012/0160653 A1 Jun. 28, 2012

(30) Foreign Application Priority Data

Dec. 27, 2010 (TW) ..... 99225121 U

(51) Int. Cl.
*H01H 9/00* (2006.01)

(52) U.S. Cl.
USPC ..... 200/314; 200/343; 200/345

(58) Field of Classification Search
USPC ..... 200/313, 314
See application file for complete search history.

(56) References Cited

U.S. PATENT DOCUMENTS

| | | | | |
|---|---|---|---|---|
| 6,861,600 | B1 * | 3/2005 | Schulz et al. | 200/310 |
| 7,423,229 | B2 * | 9/2008 | Chen | 200/314 |
| 7,619,173 | B2 * | 11/2009 | Inoue | 200/310 |
| 7,683,279 | B2 * | 3/2010 | Kim | 200/310 |
| 7,758,225 | B2 * | 7/2010 | Jung et al. | 362/602 |
| 7,893,374 | B2 * | 2/2011 | Aihara et al. | 200/314 |
| 8,063,325 | B2 * | 11/2011 | Sung et al. | 200/314 |
| 8,063,326 | B2 * | 11/2011 | Igarashi et al. | 200/314 |
| 2008/0296135 | A1 * | 12/2008 | Chikahisa et al. | 200/314 |

* cited by examiner

*Primary Examiner* — Kyung Lee
(74) *Attorney, Agent, or Firm* — Winston Hsu; Scott Margo

(57) ABSTRACT

A plurality of light-transmittable or transparent keycaps is disposed on a luminous keyboard. Between a bottom surface of each keycap and a circuit board, printed layers with various patterns corresponding to each keycap are disposed therebetween. The pattern of each printed layer is composed by a light-transmittable section and an opaque section. A light source module, which is composed by a light guide plate and a light emitting diode, can further be added to the luminous keyboard, under each keycap, so as to provide a self luminous light source for the keyboard. With the light-transmittable or transparent keycaps, the patterns or texts of the printed layers can be shown.

8 Claims, 6 Drawing Sheets

LUMINOUS KEYBOARD

BACKGROUND OF THE INVENTION

1. Field of the Invention

The invention relates to a keyboard, and more particularly, to a keyboard having keyswitches with keycaps made of light-transmittable material and printed layers forming patterns light-transmittable sections and opaque sections.

2. Description of the Prior Art

Keyboards are necessary for inputting text, symbols, or numbers in the common computer using environment. Today, keyboards also emphasize on visual effect or ornament. Luminous keyboards have been a trendy development in industry.

Whether the conventional keyboards or luminous keyboards, each keyswitch on the keyboard should have a specific pattern or text for distinguishable display. Generally these patterns are directly coated on the keycaps of the keyswitches, which goes through wearing or being stained very easily during the use of the keyboard. On the other hand, simply putting the patterns or text on the outer surface of the keycaps makes luminous keyboards boredom.

SUMMARY OF THE INVENTION

An embodiment of the invention provides a luminous keyswitch, including a circuit board, a base, a keycap, an elastic piece, and a printed circuit. The circuit board includes a switch. The base is disposed on the circuit board. The keycap is made of light-transmittable material and connected to the base via a pivot. The elastic piece is disposed on the switch and pressed by the keycap to deform to trigger the switch. The printed layer is disposed between the keycap and the circuit board and having a light-transmittable section and an opaque section to form a pattern.

Another embodiment of the invention provides a luminous keyboard, including a circuit board, a plurality of keyswitches, and a plurality of elastic pieces. The circuit board includes a plurality of switches. The plurality of keyswitches is disposed on the circuit board. Each of the keyswitches includes a base disposed on the circuit board, a keycap made of light-transmittable material and connected to the base via a pivot, and a printed layer disposed between the keycap and the circuit board and having a light-transmittable section and an opaque section to form a pattern. Each of the elastic pieces is disposed on a corresponding switch and pressed by a corresponding keycap to deform to trigger the corresponding switch.

Since the printed layers with patterns of the keyswitches are disposed between the light-transmittable keycaps and the circuit board, the printed layers are kept from direct contact of a user and are immune to wearing or stain. The printed layers may also be pre-coated to any component between the keycaps and the circuit board, which further simplifies the process of manufacture.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
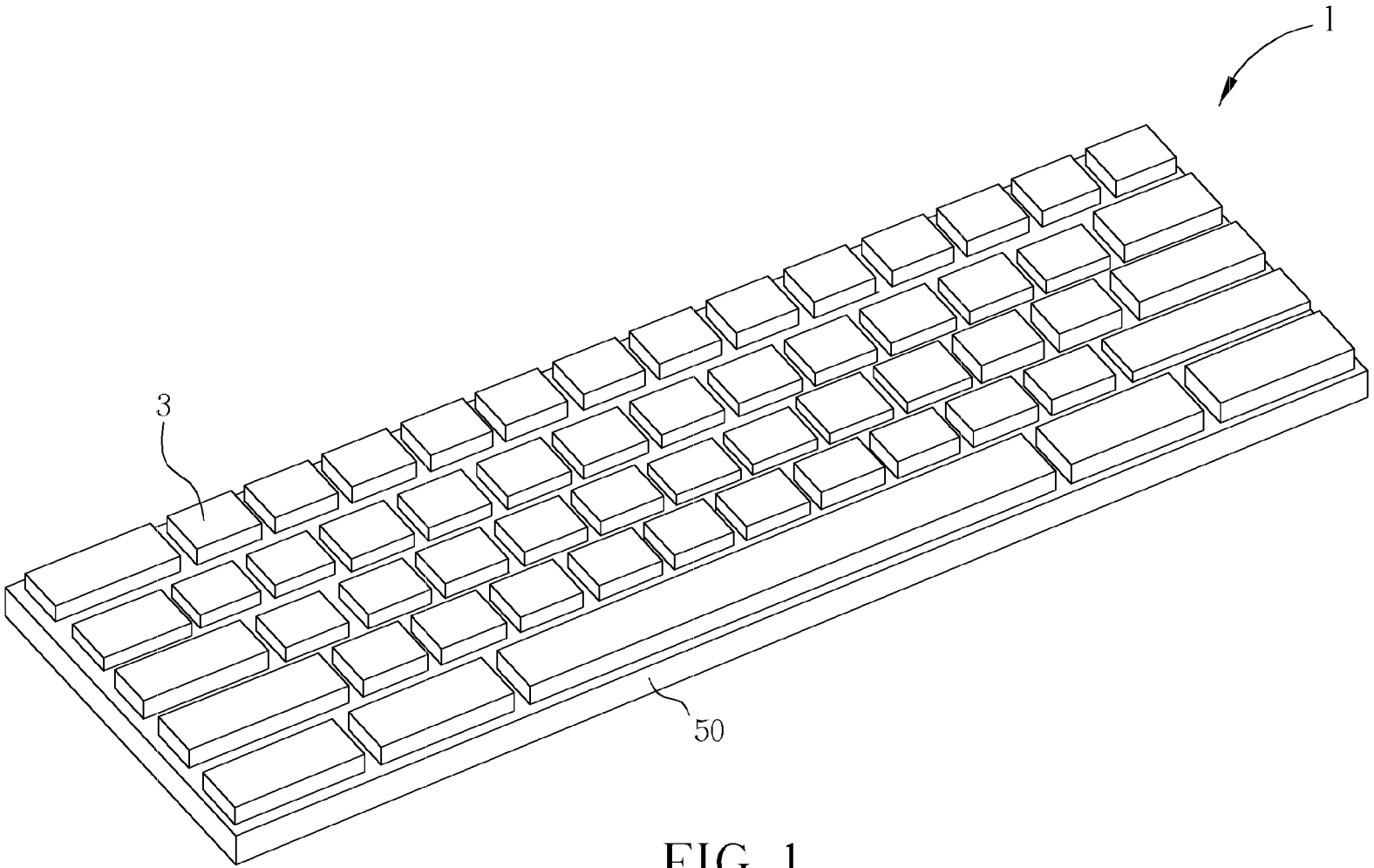
FIG. 1 is an illustration of a luminous keyboard according to an embodiment of the invention.
Figure 2:
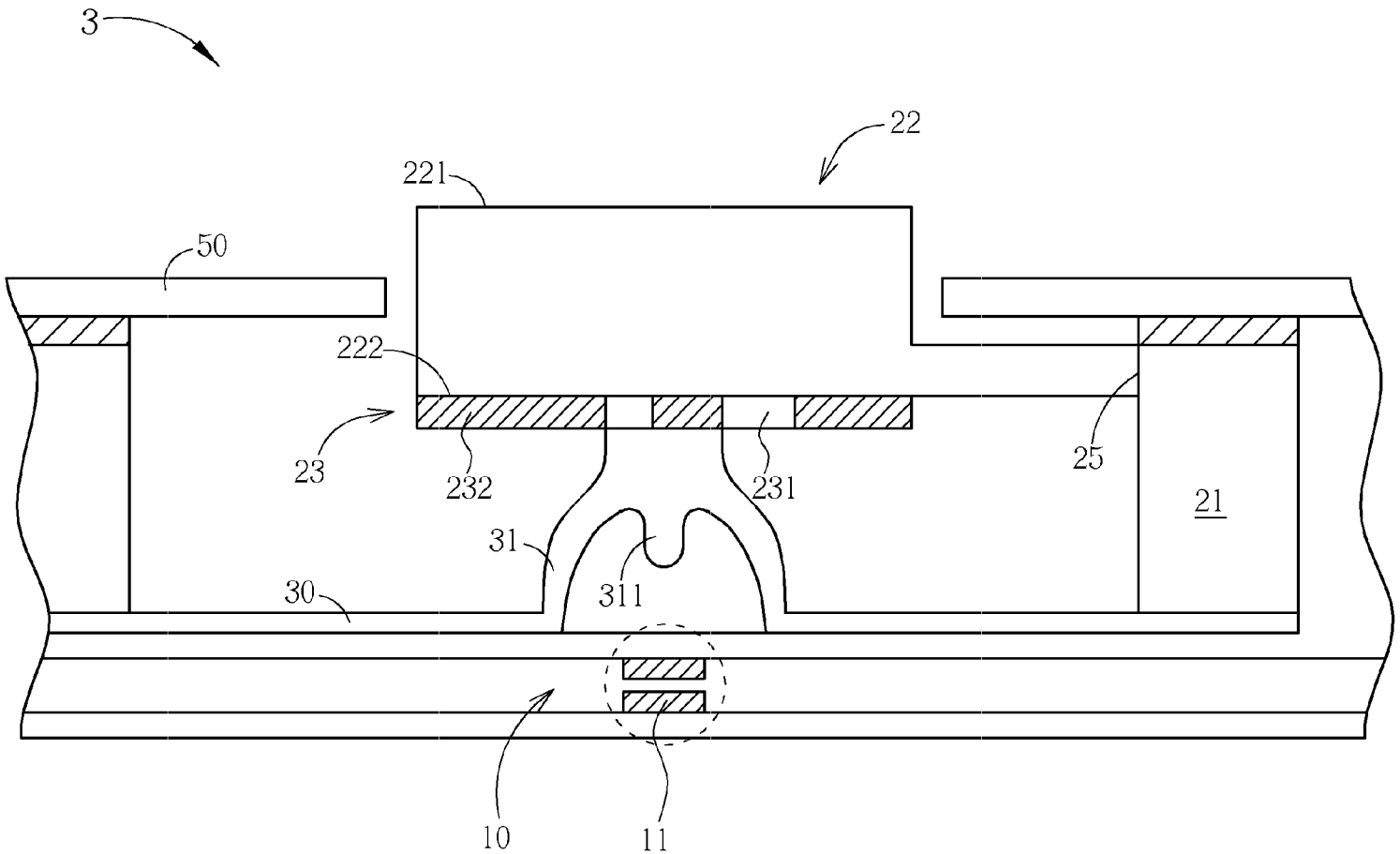
FIG. 2 is an illustration showing the sectional view of a keyswitch according to a first embodiment of the luminous keyboard of the invention.

Please refer to FIG. 1, which is an illustration of a luminous keyboard 1 according to an embodiment of the invention. The keyboard 1 includes a top cover 50 and a plurality of keyswitches 3. Please refer to FIG. 2, which is an illustration showing the sectional view of a keyswitch 3 according to a first embodiment of the luminous keyboard 1 of the invention. As shown in FIG. 2, the luminous keyswitch 3 includes a circuit board 10, a base 21, a keycap 22, an elastic piece 31, and a printed layer 23, while the top cover 50 is disposed on the keyswitch 3. In the first embodiment, the circuit board 10 may be a thin-film circuit board that has a switch 11 corresponds to the keycap 22 and the elastic piece 31 above and can be triggered by pressing. The base 21 is disposed on the circuit board 10 and can be a monolithical structure with the keycap 22 or be a separate component apart from the keycap 22.

The keycap 22 connects to the base 21 via a pivot 25 to form a cantilever beam structure and the keycap 22 is made of light-transmittable or transparent material. The keycap 22 has a top surface 221 and a bottom surface 222, wherein the top surface 221 is a surface that the user can touch and press while the bottom surface 222 is a surface opposite to the top surface 221 and faces downward toward the circuit board 10. The printed layer 23 of each keyswitch 3 has a unique text or pattern that corresponds to each keycap 22. In the first embodiment, the printed layer 23 is disposed directly on the bottom surface 222 of the keycap 22. The printed layer 23 has a light-transmittable section 231 and an opaque section 232. The light-transmittable section 231 and the opaque section 232 form the text or the pattern. Given the light-transmittable or transparent feature of the keycap 22, the printed layer 23, and the pattern on the printed layer 23, is therefore visible when viewing down from right above the keycap 22.

The elastic piece 31 of the keyswitch 3, preferably a rubber dome, is disposed between the keycap 22 and the switch 11. In some embodiments, the luminous keyboard 1 may further include a thin film 30 on which the elastic piece 31 of each keyswitch 3 is disposed. As the keycap 22 is pressed by the user to move downward, the elastic piece 31 is also pressed to deform. A triggering part 311, which is a protrusion in the embodiment, of the elastic piece 31 then pushes the switch 11 to trigger the switch 11.

Figure 3:
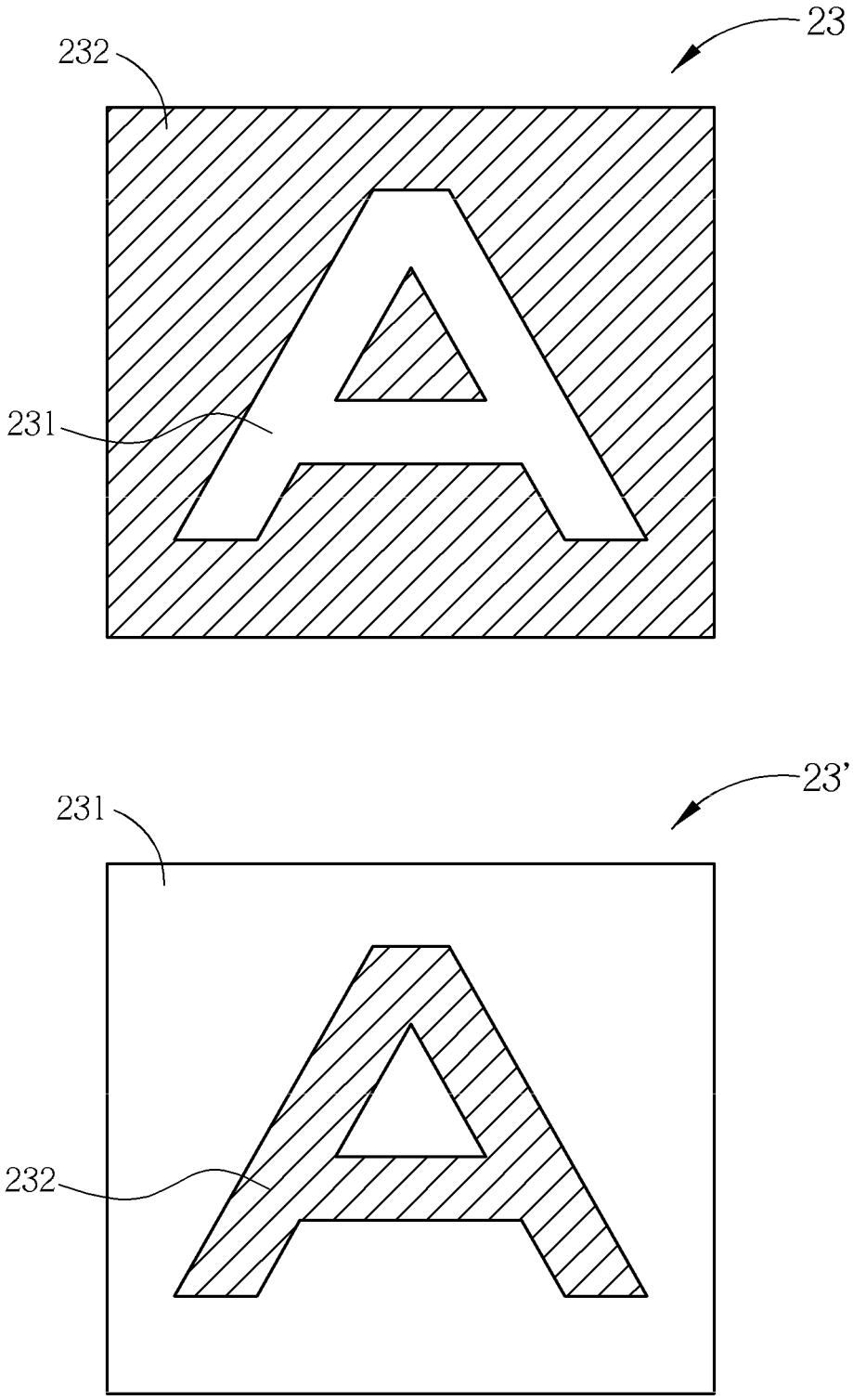
FIG. 3 is an illustration of a printed layer of a keyswitch of the luminous keyboard.

Please refer to FIG. 3, which is an illustration of a printed layer 23 of a keyswitch 3 of the luminous keyboard 1. As described above, the printed layer 23 includes the light-transmittable section 231 and the opaque section 232. The shade of the opaque section 232 gives a clear display of a specific pattern of the printed layer 23 on the keycap 22. The configuration of the light-transmittable section 231 and the opaque section 232 may also be presented as shown in the printed layer 23'.

Figure 4:
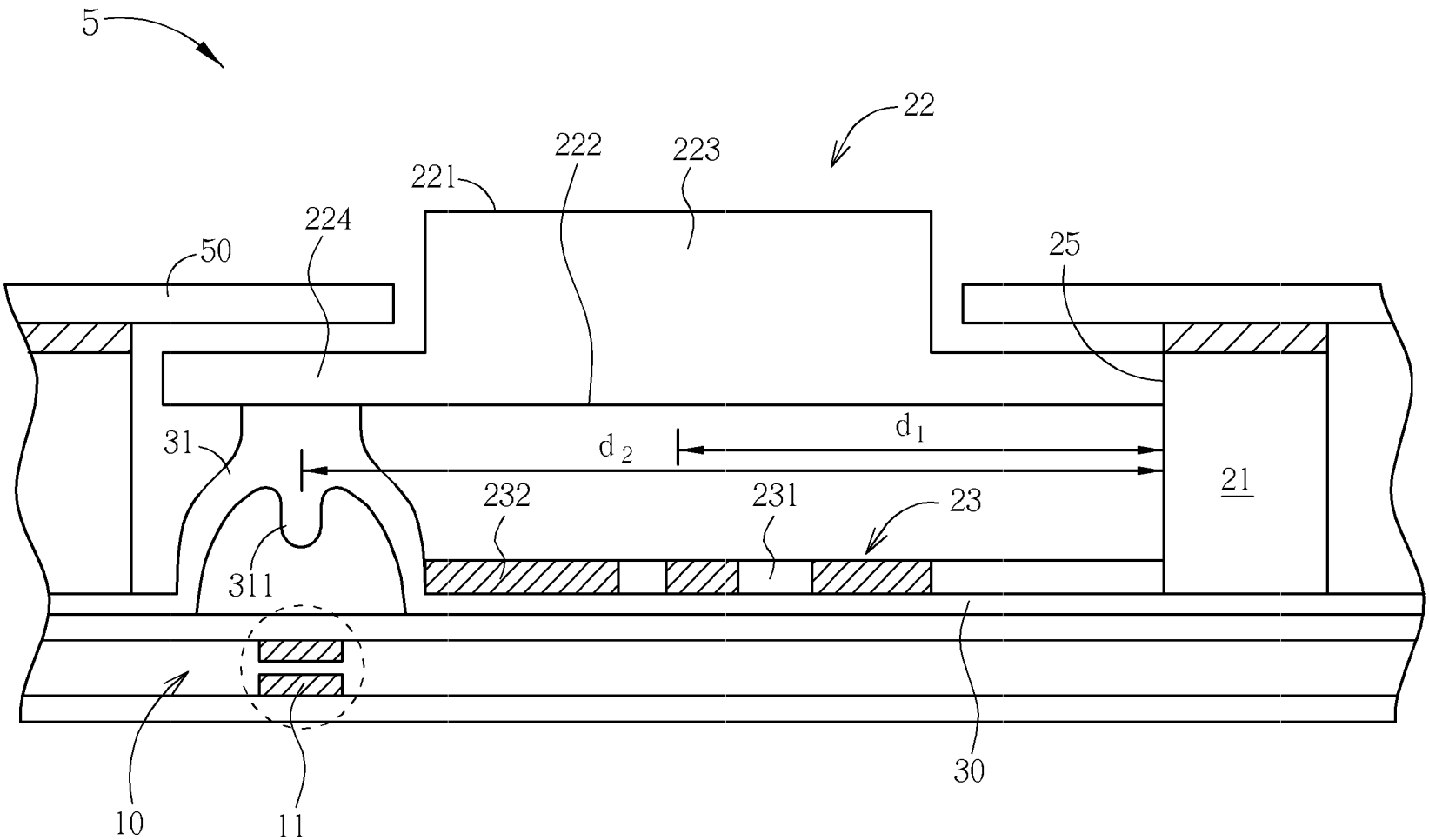
FIG. 4 is an illustration showing the sectional view of a keyswitch according to a second embodiment of the luminous keyboard of the invention.

Please refer to FIG. 4, which is an illustration showing the sectional view of a keyswitch 5 according to a second embodiment of the luminous keyboard 1 of the invention. In the second embodiment, the keycap 22 of the keyswitch 5 includes a pressing section 223 and an extension section 224. The extension section 224 extends to a position that locates under the top cover 50 so that the horizontally oriented top cover 50 may withstand the extension section 224 to prevent the keycap 22 from overly bouncing upward when the keycap 22 is pressed and having vertical movement. The elastic piece 31 of the keyswitch 5 is disposed between the switch 11 and the extension section 224, and the printed layer 23 is disposed on the thin film 30. Since the elastic piece 31 is not disposed under the pressing section 223, a space between the pressing section 223 of the keycap 22 and the circuit board 10 (or the thin film 30) is provided therebetween, which will not block the display of the printed layer 23. Additionally, the cantilever beam structure of the keycap 22 gives the elastic piece 31 clear sense of click since the extension section 224 of the keycap 22 lies farther from the pivot 25 horizontally (than the pressing section 223), which in other words, the distance $d_2$ between the extension section 224 and the pivot 25 is larger than the distance $d_1$ between the pressing section 223 and the pivot 25.

Figure 5:
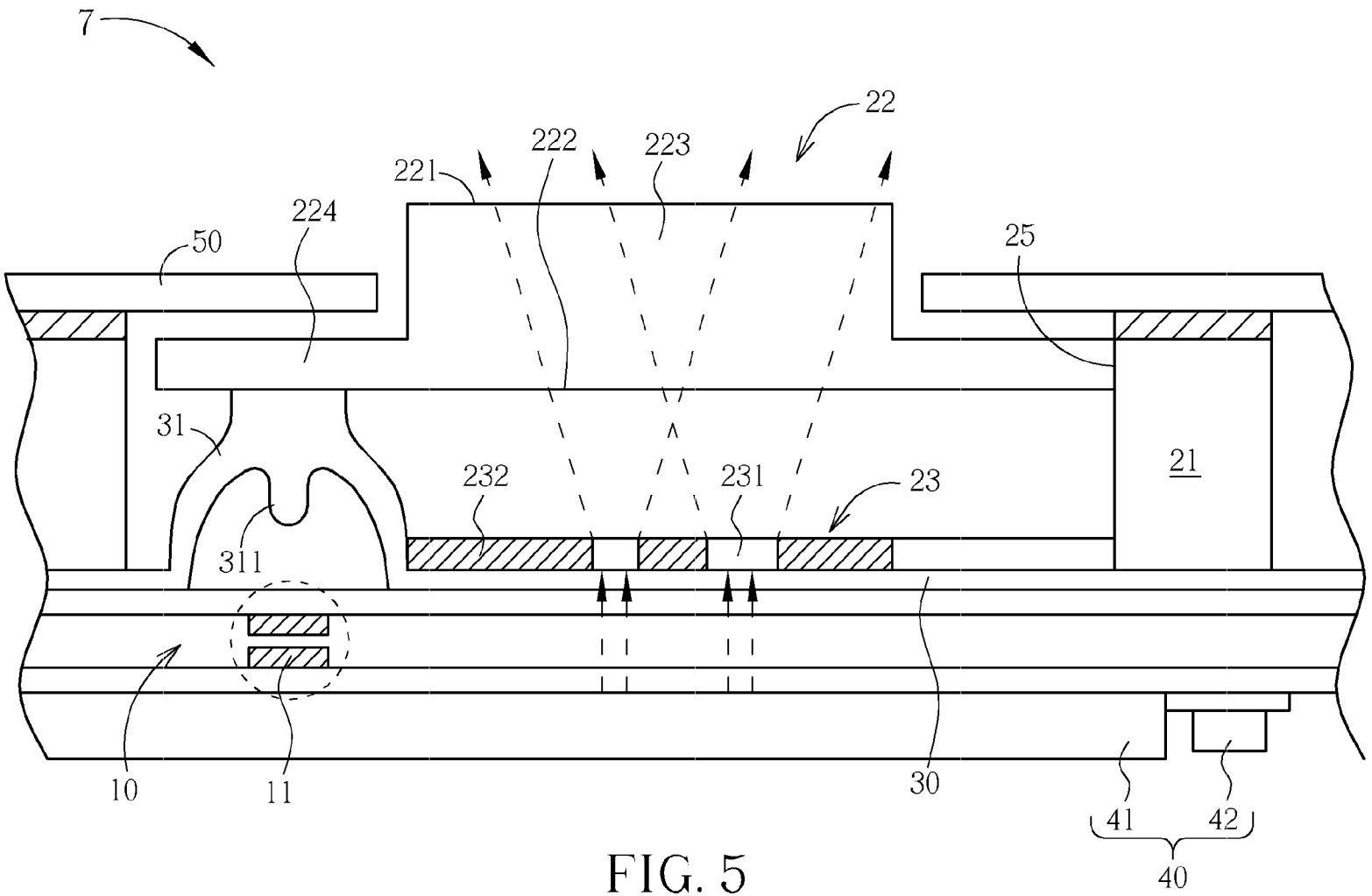
FIG. 5 is an illustration showing the sectional view of a keyswitch according to a third embodiment of the luminous keyboard of the invention.

Please refer to FIG. 5, which is an illustration showing the sectional view of a keyswitch 7 according to a third embodiment of the luminous keyboard 1 of the invention. In the third embodiment, the pressing section 223 and the extension section 224 of the keycap 22 of the keyswitch 7 have structures and features as described in the previous embodiment. The printed layer 23 is also disposed on the thin film 30 to display pattern through the keycap 22. The keyswitch 7 further includes a light source module 40, which includes a light guide plate 41 and a light emitting diode 42. The light guide plate 41 is disposed below the circuit board 10, where the thin film circuit board 10 is also transparent or light-transmittable structure. The light emitting diode 42 is disposed at a side of the light guide plate 41 and wired on the circuit board 10. The wiring of the light emitting diode 42 is not shown in the figure. In this embodiment, the luminous keyboard 1 uses the light source module 40 to provide a light source, which gives out effect of active luminescence. As the light source module is deployed below the circuit board 10, the lights emitted by the light emitting diode 42 go through the light guide plate 41 and project evenly upward, through the circuit board 10 and the light-transmittable section 231 of the printed layer 23, and finally project out of the keycap 22.

Figure 6:
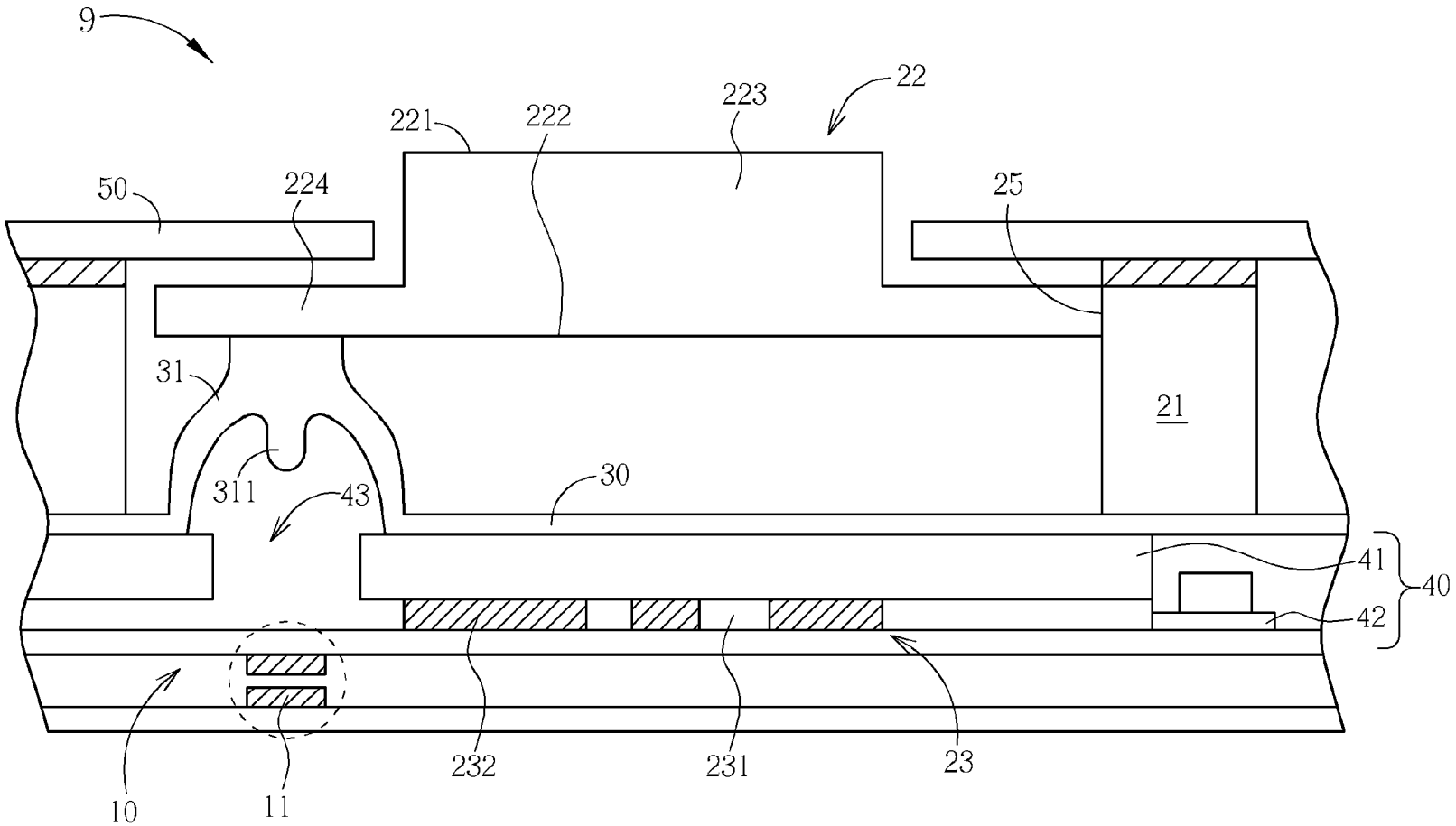
FIG. 6 is an illustration showing the sectional view of a keyswitch according to a fourth embodiment of the luminous keyboard of the invention.

Please refer to FIG. 6, which is an illustration showing the sectional view of a keyswitch 9 according to a fourth embodiment of the luminous keyboard 1 of the invention. In the fourth embodiment, the pressing section 223 and the extension section 224 of the keycap 22 of the keyswitch 9 have structures and features as described in the previous embodiment. The light source module 40 is disposed between the circuit board 10 and the elastic piece 41 (or the thin film 30 having the elastic piece 31). The printed layer 23 is disposed on the circuit board 10 or the light guide plate 41. The light guide plate 41 is disposed between the elastic piece 41 and the circuit board 10 and has an opening 43 corresponding to the position of the switch 11 and the elastic piece 31 such that the triggering part 311 of the elastic piece 31 may pass through the opening 43 to effectively trigger the switch 11. Since the pressing section 233 of the keycap 22, the thin film 30, the light guide plate 41, the light-transmittable section 231 of the printed layer 23, and the thin-film circuit board 10 are all made of light-transmittable material, the lights emitted by the light source module 40 provides visual effect of active luminescence and the pattern of the printed layer 23 may be displayed on the keyswitch 9.

The luminous keyboard in the embodiments of the invention includes a plurality of light-transmittable or transparent keycaps. Between the bottom surface of the non-pressing section of each keycap and the circuit board, printed layers with various patterns corresponding to each keycap are disposed therebetween. The pattern of each printed layer is composed by the light-transmittable section and the opaque section. The light source module, which is composed by the light guide plate and the light emitting diode, can further be added to the luminous keyboard, under each keycap, so as to provide a self luminous light source for the keyboard. With the light-transmittable or transparent keycaps, the patterns or texts of the printed layers can be shown. The printed layers are also immune to wearing or stain during the use of the keyboard.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A luminous keyboard, comprising:

a circuit board comprising a plurality of switches;

a plurality of keyswitches disposed on the circuit board, each of the keyswitches comprising:

a base disposed on the circuit board;

a keycap made of light-transmittable material, the keycap connected to the base via a pivot; and a printed layer disposed between the keycap and the circuit board and having a light-transmittable section and an opaque section to form a pattern;

a plurality of elastic pieces, each disposed on a corresponding switch and pressed by a corresponding keycap to deform to trigger the corresponding switch; and a light source module disposed on the circuit board, the light source module emitting lights that project out of the keycaps through the light-transmittable sections of the printed layers and through the keycaps, the light source module comprising:

a light guide plate disposed between the circuit board and the plurality of elastic pieces, the light guide plate comprising a plurality of openings, each opening corresponding to each corresponding elastic piece and each corresponding switch, and an triggering part of each elastic piece passing through corresponding opening to trigger the corresponding switch; and a light emitting diode disposed at a side of the light guide plate.

2. The keyboard of claim 1, wherein each keycap comprises a top surface and a bottom surface opposite to the top surface, the bottom surface facing the circuit board and the printed layer disposed on the bottom surface.

3. The keyboard of claim 1, further comprising a thin film, disposed between the plurality of elastic pieces and the circuit board, the printed layer disposed on the thin film.

4. The keyboard of claim 1, wherein the printed layer is disposed on the circuit board.

5. The keyboard of claim 1, wherein the printed layer is disposed on the light guide plate.

6. The keyboard of claim 1, wherein the keycap of each keyswitch is made of transparent material.

7. The keyboard of claim 1, wherein the circuit board is a thin-film circuit board.

8. The keyboard of claim 1, wherein the keycap of each keyswitch comprises a pressing section and an extension section, the distance between the extension section and the pivot is larger than the distance between the pressing section and the pivot, the corresponding elastic piece disposed between the extension section and the corresponding switch.

* * * * *